US005695183A

United States Patent [19]

Stoub

[11] Patent Number: 5,695,183

[45] Date of Patent: Dec. 9, 1997

[54] PAPER INTERLEAVER

[75] Inventor: James W. Stoub, Mokena, Ill.

[73] Assignee: NuTec Manufacturing, Inc., New Lenox, Ill.

[21] Appl. No.: 496,446

[22] Filed: Jun. 29, 1995

[51] Int. Cl.[6] ..... B65H 5/08

[52] U.S. Cl. ..... 271/14; 271/20; 271/100; 271/102; 271/104; 271/132; 271/165; 271/166; 271/167; 221/211

[58] Field of Search ..... 221/211; 271/11, 271/14, 19, 20, 100, 102, 104, 161, 165, 166, 167, 132

[56] References Cited

U.S. PATENT DOCUMENTS

| | | | |
|---|---|---|---|
| 691,294 | 1/1902 | Schilz . | |
| 1,278,438 | 9/1918 | Conradi | 271/165 |
| 1,366,275 | 1/1921 | Payzant . | |
| 2,198,176 | 4/1940 | Perrin | 312/51 |
| 2,554,821 | 5/1951 | Garfunkel | 216/51 |
| 3,232,478 | 2/1966 | Thomasma et al. | 221/33 |
| 3,285,605 | 11/1966 | Vasse | 271/166 |
| 3,360,258 | 12/1967 | Nix | 271/18 |
| 3,461,483 | 8/1969 | Felstehausen | 17/32 |
| 3,589,711 | 6/1971 | Holly | 271/10 |
| 3,675,387 | 7/1972 | Lekan | 53/157 |
| 3,724,687 | 4/1973 | Marschke et al. | 271/11 |
| 3,952,478 | 4/1976 | Richards et al. | 53/122 |
| 4,283,812 | 8/1981 | Corominas | 17/32 |
| 4,302,868 | 12/1981 | Wagner | 17/32 |
| 4,346,817 | 8/1982 | Karcher | 221/312 |
| 4,530,132 | 7/1985 | Wagner | 17/45 |
| 4,537,307 | 8/1985 | Tamura | 206/455 |
| 4,589,648 | 5/1986 | Hancock | 271/104 |
| 4,597,134 | 7/1986 | Wagner | 17/32 |
| 5,137,172 | 8/1992 | Wagner et al. | 221/26 |

FOREIGN PATENT DOCUMENTS

| | | | |
|---|---|---|---|
| 1294940 | 4/1962 | France | 221/211 |
| 1257776 | 1/1968 | Germany | 271/102 |

*Primary Examiner*—H. Grant Skaggs
*Attorney, Agent, or Firm*—Wood, Phillips, VanSanten, Clark & Mortimer

[57] ABSTRACT

A paper feed system suitable for use with a portion control machine to provide paper sheets for separating portions, including a paper hopper mountable to a portion control machine and adapted to receive and temporarily retain a stack of paper sheets. The paper hopper has an open end having a front edge spaced opposite from a back edge and defining a ready position where a paper sheet lies in a first plane to be dispensed. The paper feed system further includes a paper support having a length to width ratio of 10 to 1 or greater. The paper support is mounted adjacent the open end of the paper hopper blocking the free exit of paper sheets therefrom, with the support extending from a central location on the back edge partially to a central location on the front edge. An upper surface of the support is substantially parallel with the first plane and is adjacent the first plane for retention of a paper sheet in the ready position. The paper feed system further includes a pair of paper support tabs mounted adjacent the central location on the front edge but spaced laterally from the paper support. The paper support tabs extend partially into the open end blocking the free exit of paper sheets therefrom and have an upper surface substantially parallel with the first plane and adjacent the first plane for retention of a central portion of a leading edge of a paper sheet in the ready position.

22 Claims, 6 Drawing Sheets

PAPER INTERLEAVER

FIELD OF THE INVENTION

The present invention is directed toward a paper feed system suitable for use with a portion control machine to provide paper sheets for separating portions, and more particularly toward a paper feed system having a paper hopper cooperating with a vacuum bar to interleave single paper sheets between patties formed by the portion control machine.

BACKGROUND OF THE INVENTION

Before automation, it was common to form patties of materials, such as ground meat, by hand. However, this technique has numerous drawbacks including the unsanitary conditions resulting from human contact with the material, the lack of uniformity in the weight, size, and shape of the patties and the limitations of the per worker output inherent in labor intensive processes.

Apparatus for forming patties overcome many of the shortcomings of hand-forming patties. These apparatus can produce patties in a sanitary manner that are substantially uniform in size, shape, and weight and result in significant increases in per worker output. Representative of these apparatus are U.S. Pat. No. 4,283,812 to Corominas, U.S. Pat. No. 4,302,868 to Wagner, and U.S. Pat. No. 4,597,134 to Wagner.

Typically, the patty making apparatus has a mechanism that dispenses paper to be contacted with the patty to ensure the separation of the patty from other patties and surfaces.

Some paper-dispensing mechanisms utilize pre-cut sheets of paper that have a hole in the back of the paper. Sheets of paper are arranged in a stack with the aligned holes fitted over a rod or pin from which the paper is torn during dispensing. Unfortunately requiring a rod to be threaded through the hole increases the difficulty in loading the paper.

Further, having a hole in the back of the paper results in a gap in the paper that usually is expanded when the paper is torn from the rod. The gap can result in an exposed surface of the patty undesirably adherent to, or being contaminated by, other surfaces. The length of the paper can be increased to compensate for this gap. However, lengthening it is undesirable because of the increased expense associated with increased paper consumption.

Also, cutting or tearing of the paper by the paper dispensing mechanism can undesirably result in small fragments of paper being deposited upon the patty.

Other paper dispensing mechanisms utilize pre-cut sheets of paper having no hole in the back of the paper. The pre-cut sheets of paper are initially pulled from the stack in an initial direction having a substantial vector component parallel to the plane of the paper. Such mechanisms have a tendency to remove more than one sheet at a time, which is undesirable due to the increased paper consumption.

Some mechanisms have attempted to initially pull the paper sheet from the stack in a direction that is substantially perpendicular to the plane of the paper sheet. Representative of these mechanisms are U.S. Pat. No. 3,675,387 to Lekan and U.S. Pat. No. 3,952,478 to Richards et al. However, these mechanisms require complex assemblies having multiple devices dedicated to removing a paper sheet from the hopper and to transferring a paper sheet to a patty. Further, these mechanisms require exposed gearing, sprockets, and chain drives which are undesirable in the food processing environment because of their tendency to collect dust and other contaminants and to then introduce these contaminants into the food process. Additionally, because these mechanisms do not fully support the paper sheets throughout the dispensing process, the mechanisms are limited as to the type and quality of the paper sheets which they may successfully employ.

It is desirable to provide a paper feed system suitable for use with portion control machine that overcomes the aforementioned shortcomings.

SUMMARY OF THE INVENTION

In one aspect of the present invention, a paper feed system suitable for use with a portion control machine to provide paper sheets for separating portions is provided, including a paper hopper mountable to a portion control machine and adapted to receive and temporarily retain a stack of paper sheets. The paper hopper has an open end having a front edge spaced opposite from a back edge and defining a ready position where a paper sheet lies in a first plane to be dispensed. The paper feed system further includes a paper support having a length to width ratio of 10 to 1 or greater. The paper support is mounted adjacent the open end of the paper hopper blocking the free exit of paper sheets therefrom, with the support extending from a central location on the back edge partially to a central location on the front edge. An upper surface of the support is substantially parallel with the first plane and is adjacent the first plane for retention of a paper sheet in the ready position.

In another aspect of the present invention the paper support extends one third to two thirds of the way from the back edge to the front edge, and preferably extends halfway from the back edge to the front edge.

In another preferred aspect of the present invention, the paper support is a rod which extends one third to two thirds of the way to the central location on the front edge and has a curved upper surface which is substantially parallel with the first plane and adjacent the first plane for retention of a paper sheet in the ready position.

In one aspect of the present invention, the paper feed system includes a paper hopper, a carriage, a paper securing bar, and a first actuator. The paper hopper is mountable to a portion control machine and adapted to receive and temporary retain a stack of paper sheets, with a paper sheet of the stack retained in a ready position where a surface of the paper sheet faces outward from the paper hopper. The carriage is mountable to a portion control machine for movement relative to the paper hopper between a paper dispensing position adjacent a food portion and a paper loading position adjacent the ready position. The paper securing bar is adapted for selectively securing to a paper sheet and is mounted on the carriage for translating movement relative to the carriage along an axis substantially perpendicular to a plane defined by a paper sheet in ready position. The first actuator is mounted on the carriage for translating the paper securing bar along the substantially perpendicular axis when the carriage is in the paper loading position. The first actuator is adapted to translate the paper securing bar between a first position where the paper securing bar will contact and secure to a paper sheet retained in a ready position and a second position, spaced from the ready position, where the paper securing bar will at least partially remove a paper sheet from the ready position.

In a preferred aspect of the present invention, the securing bar includes a pair of vacuum orifices located on the securing bar to contact and secure a paper sheet retained in the ready position on opposite sides of the paper support when the securing bar is in the first position.

In another preferred aspect of the present invention, the paper feed system further includes a pair of paper support tabs mounted adjacent the central location on the front edge but spaced laterally from the paper support. The support tabs extend partially into the open end blocking the free exit of paper sheets therefrom and have an upper surface substantially parallel with the first plane and adjacent the first plane for retention of a central portion of a leading edge of a paper sheet in the ready position.

In yet another preferred aspect of the present invention, the paper feed system further includes a stack of paper sheets temporarily retained in the paper hopper, with a first sheet of the stack secured to the securing bar by a pair of vacuum orifices on opposite sides of the paper support. The first sheet is bent about the paper support and pulled from the support tabs. A second sheet of the stack is retained in the ready position by the support tabs.

It is an object of the present invention to provide a paper feed system for a portion control machine in which single sheets of paper will be reliably fed between formed portions.

It is another object of the present invention to provide a paper feed system which does not introduce any loose shreds of paper into the portion environment (which shreds could undesirably get mixed with the portion).

Still another object of the present invention is to provide a paper feed system that can provide the above enumerated advantages without being unduly limited as to the quality and type of paper used in the system.

Yet another object of the present invention is to provide a paper feed system which will provide the above enumerated advantages without requiring complex assemblies having multiple devices for removing paper from a hopper and for transferring the paper to a portion loading position.

Numerous other advantages and features of the present invention will become readily apparent from the following detailed description of the invention, the accompanying figures and the appended claims.

DETAILED DESCRIPTION OF THE PREFERRED EMBODIMENTS

Although this invention is susceptible to embodiment in many different forms, preferred embodiments of the invention are shown. It should be understood, however, that the present disclosure is to be considered as an exemplification of the principles of this invention and is not intended to limit the invention to the embodiments illustrated.

Figure 1A:
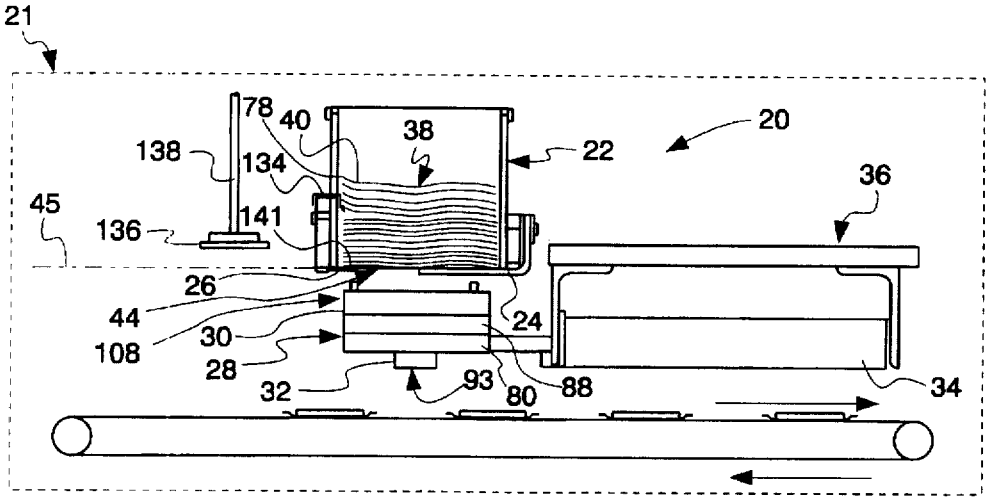
FIGS. 1*a*, 1*b*, 1*c*, 1*d*, 1*e*, and 1*f* are schematic representations of the paper feed system embodying the present invention and illustrating the sequence of operation.

FIG. 1*a* illustrates a preferred embodiment of the present paper feed system 20 which is suitable for use with a portion control machine 21. The paper feed system 20 includes a paper hopper 22, a paper support 24, paper support tabs 26, a carriage 28, a paper securing bar 30, a first actuator 32, a second actuator 34, and a frame 36.

Figure 4:
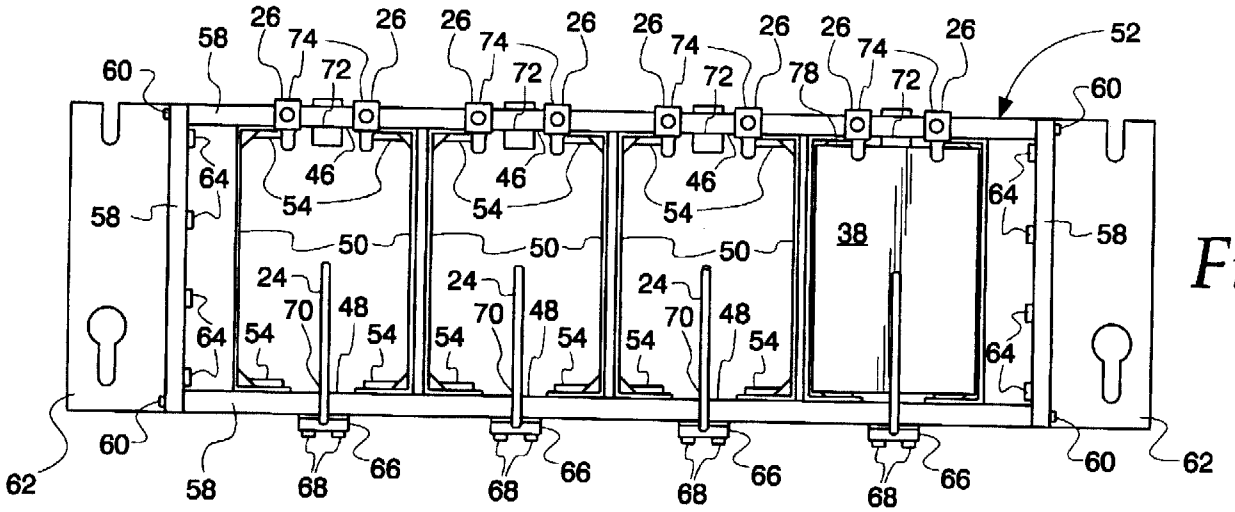
FIG. 4 is a bottom elevational view taken along line 4—4 of FIG. 3.
Figure 5:
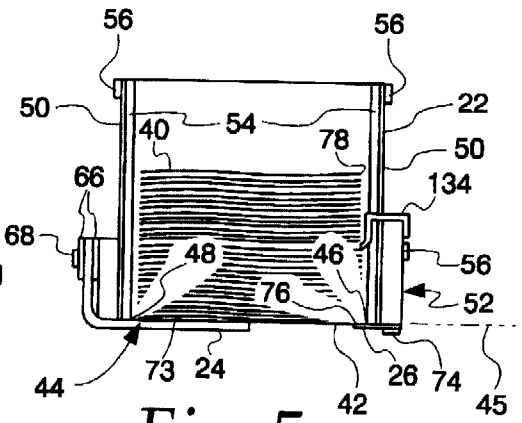
FIG. 5 is a sectional view taken along line 5—5 of FIG. 2.
Figure 3:
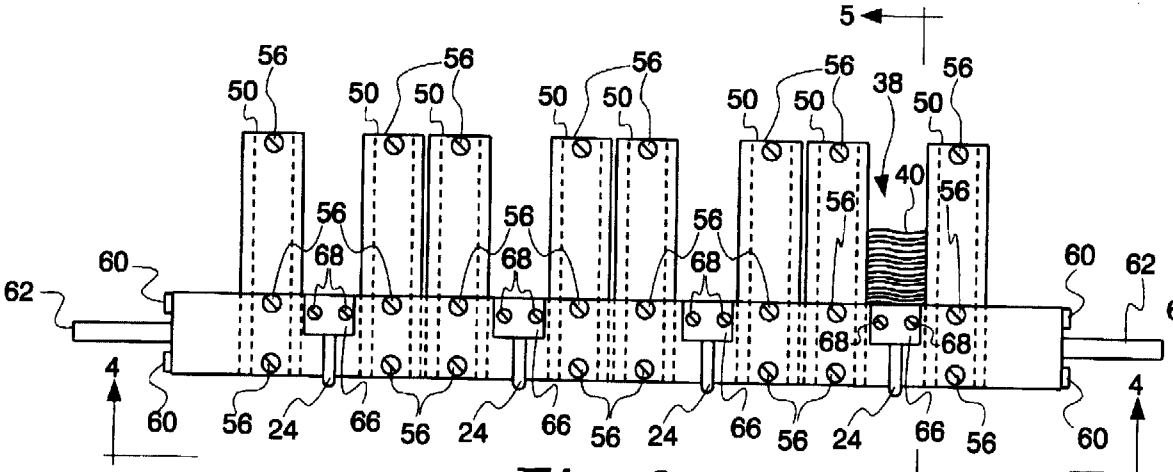
FIG. 3 is a back elevational view of selected carriage and actuator components from the paper feed system shown in FIG. 1.

The paper hopper 22 is adapted to receive and temporarily retain a stack 38 of paper sheets 40, as best seen in FIGS. 3, 4 and 5. The paper hopper 22 has an open end 42 defining a ready position 44 where a paper sheet 40 is supported in a first plane 45 to be dispensed. The open end 42 has a front edge 46 spaced opposite from a back edge 48 (see FIG. 5).

The paper hopper 22 further includes paper retaining panels 50 defining side, front, and back walls, and an open, box shaped support frame 52. The panels 50 are held against the support frame 52 by panel support bars 54 which are fastened to the support frame 52 and the panels 50 by suitable fasteners 56. The hopper support frame 52 is formed by four elongated rectangular bars 58 which are joined together by suitable fasteners 60. Mount flanges 62 are attached to the support frame 52 by suitable fasteners 64.

The paper support 24 is mounted to the support frame 52 adjacent the open end 42 blocking the free exit of paper sheets 40 therefrom, as best seen in FIGS. 1*a* and 5. The paper support 24 is attached to the support frame 52 by a bracket 66 and suitable fasteners 68, as best seen in FIGS. 3, 4, and 5. The paper support 24 extends in a forward direction from a central location 70 on the back edge 48 partially to a central location 72 on the front edge 46, as best seen in FIG. 4. As best seen in FIG. 5, the paper support 24 is a rod having a circular cross section, with an upper surface 73 of the paper support 24 being substantially parallel and adjacent with the first plane 45 for retention of a paper sheet 40 in the ready position 44.

The paper support tabs 26 are mounted adjacent the central location 72 on the front edge 46, but are spaced laterally from the paper support 24. The support tabs 26 extend in a rearward direction partially into the open end 42 blocking the free exit of paper sheets 40 therefrom, as best seen in FIGS. 4 and 5. The support tabs 26 are attached to the hopper support frame 52 by suitable fasteners 74. Each support tab has an upper surface 76 (see FIGS. 1*a* & 5) that is substantially parallel and adjacent the first plane 45 for retention of a central portion of a leading edge 78 of a paper sheet 40 in the ready position 44.

Figure 6:
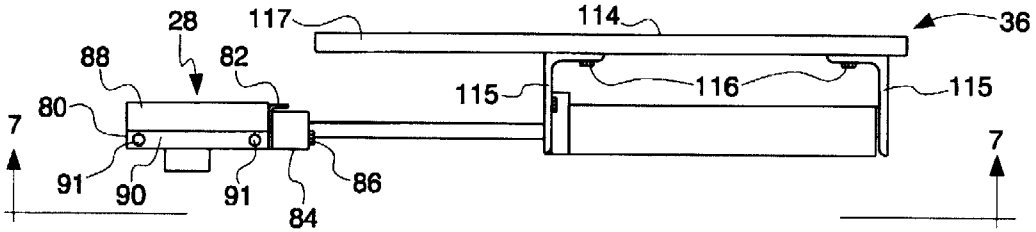
FIG. 6 is a side elevational view of selected carriage and actuator components from the paper feed system shown in FIG. 1.
Figure 7:
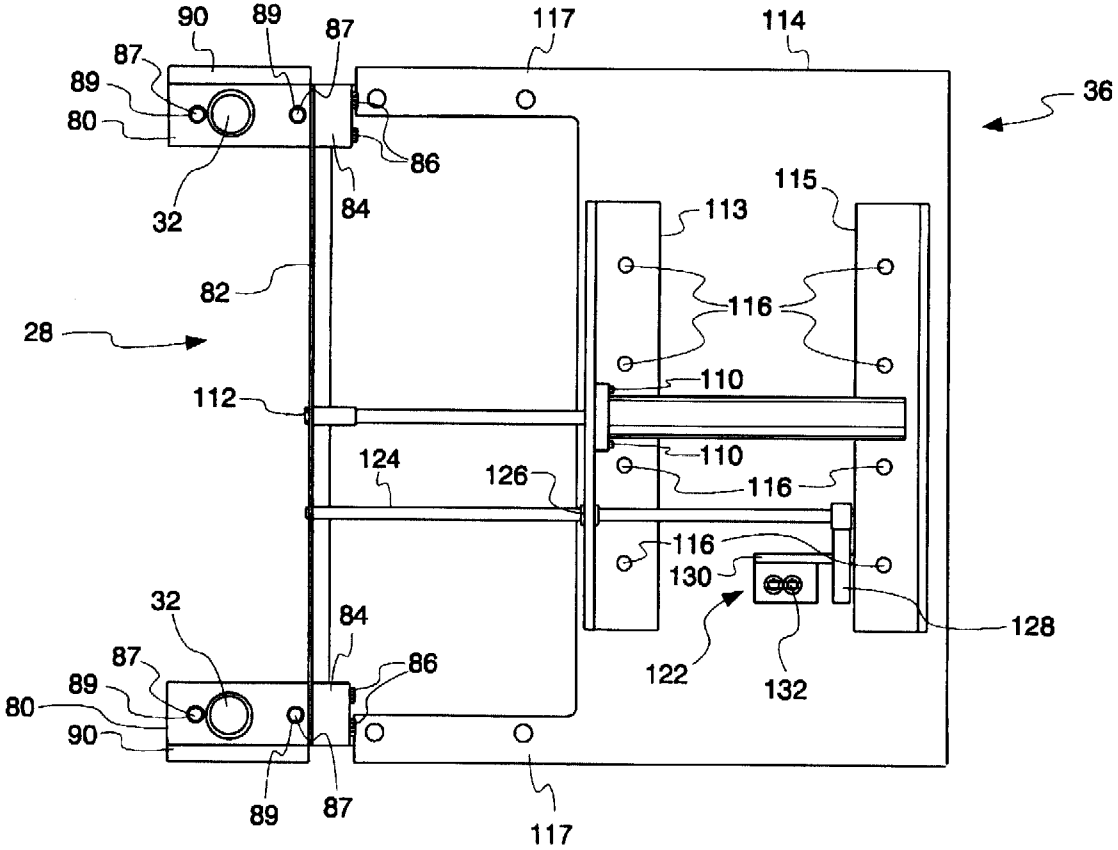
FIG. 7 is a view taken substantially along line 7—7 of FIG. 6.

As best seen in FIGS. 6 and 7, the carriage 28 includes a pair of actuator platforms 80 which are attached to a carriage frame bar 82 by brackets 84 and suitable fasteners 86. As best seen in FIG. 16, each actuator platform 80 includes a pair of bracket 88 for vertical linear motion by mating with a pair of vertical guide posts 87 fixed in the securing bar mount bracket 88.

The carriage 28 is mounted to a portion control machine 21 for sliding linear motion by gibs 90 which slidably mount in ways (not shown) provided in the portion control machine 21. The gibs 90 are mounted to the actuating platforms 80 by suitable fasteners 91. The carriage 28 moves relative to the paper hopper 22 between a paper dispensing position 92 adjacent a food portion 136, as best seen in FIGS. 1*d*, 1*e*, and 1*f*, and a paper loading position 93 adjacent the ready position 44 as best seen in FIGS. 1*a*, 1*b*, and 1*c*.

Figure 2B:
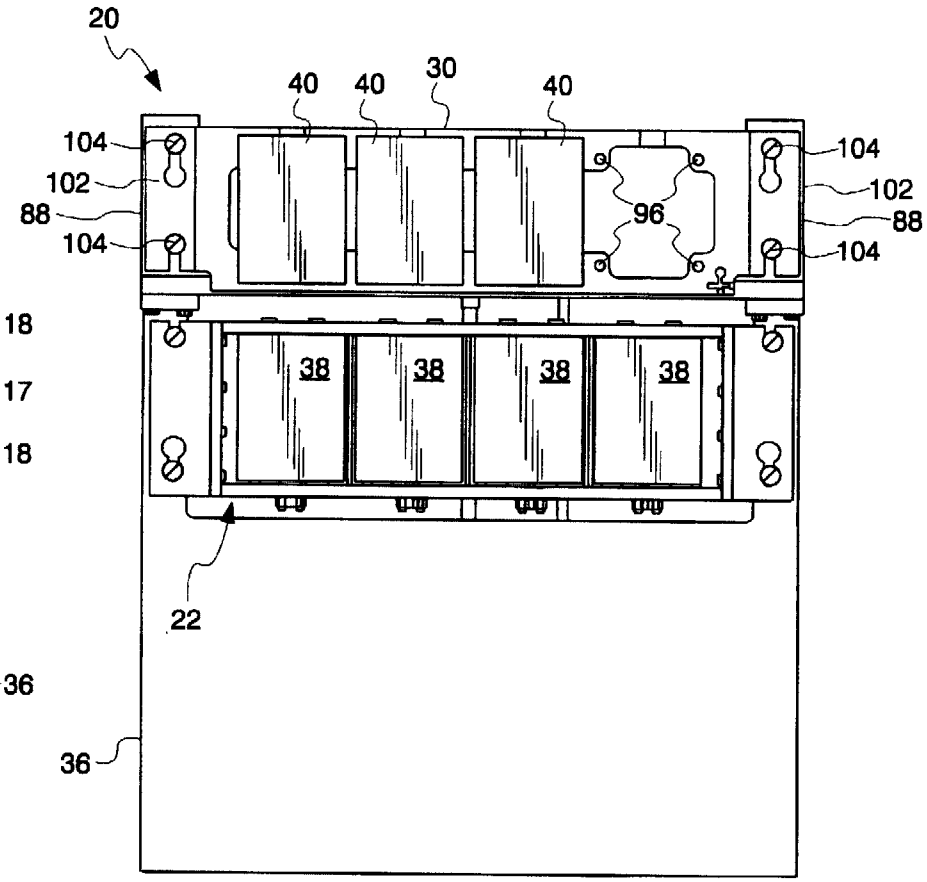
FIG. 2*b* is a top elevational view of the paper feed system shown in FIG. 2*a* with the feed system in a paper dispensing position.
Figure 8:
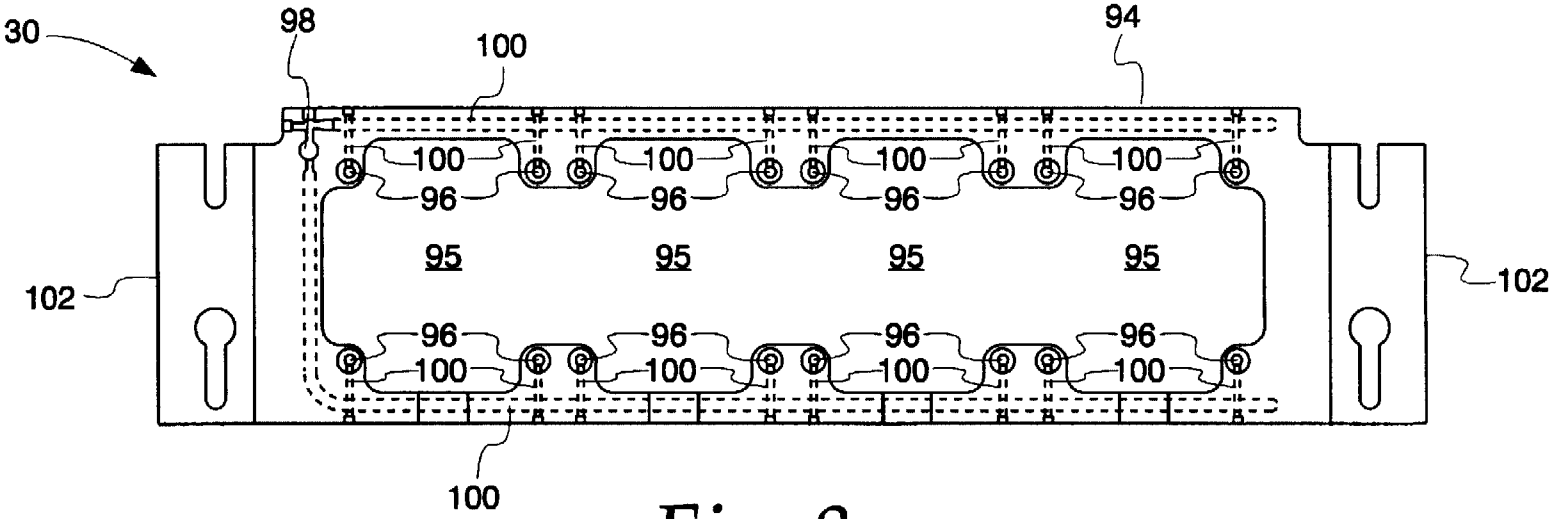
FIG. 8 is a top plan view of selected paper securing components from the paper feed system shown in FIG. 1.
Figure 9:
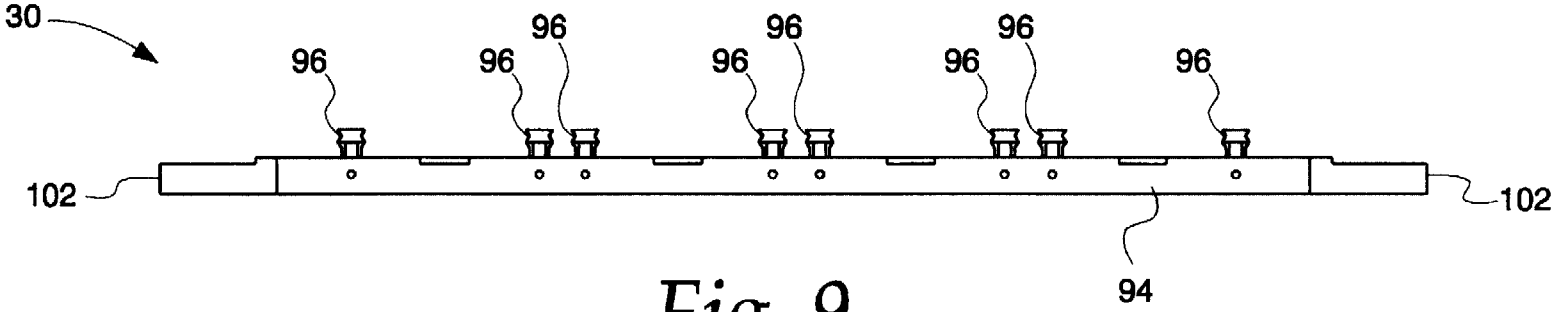
FIG. 9 is a front elevational view of the selected components shown in FIG. 8.

As best seen in FIGS. 8 and 9, the paper securing bar 30 includes an open, box shaped frame 94 defining four open rectangular paper dispensing stations 95. Vacuum orifices or cups 96 are located at each of the four corners of each of the paper dispensing stations 95 and are joined to a vacuum supply port 98 in the frame 94 by vacuum passages 100, also formed in the frame 94. As best seen in FIG. 2*b*, the paper securing bar 30 is mounted to the carriage 28 by a pair of mount flanges 102 on the frame 94 which are joined to the securing bar mount brackets 88 by suitable fasteners 104.

As best seen in FIGS. 6 and 7, the first actuators 32 are mounted to the actuator platforms 80 for translating the paper securing bar 30 along an axis that is substantially perpendicular to the first plane 45 when the carriage 28 is in the paper loading position. The first actuators 32 are in the form of pneumatic cylinders and are adapted to translate the paper securing bar 30 between a first position 106, as best seen in FIG. 1*b*, where the paper securing bar will contact and secure to a paper sheet 141 retained in the ready position 44 and a second position 108, as best seen in FIG. 1*c*, spaced from the ready position 44, where the paper securing bar 30 will at least partially remove a paper sheet 141 from the ready position 44.

Figure 1B:
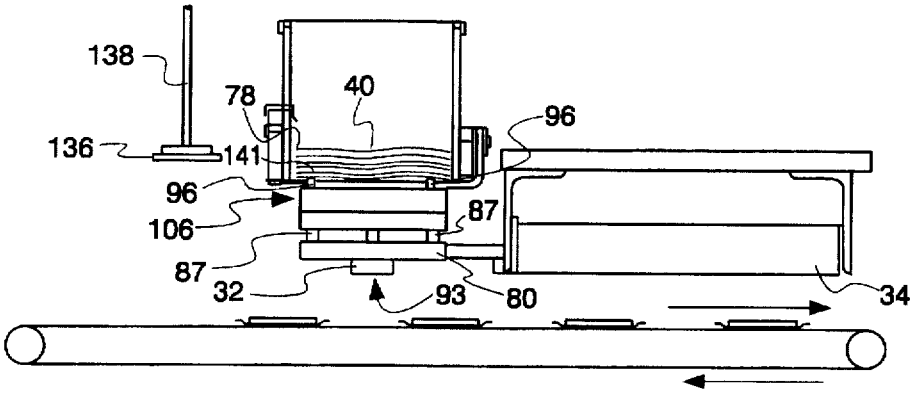
Figure 1C:
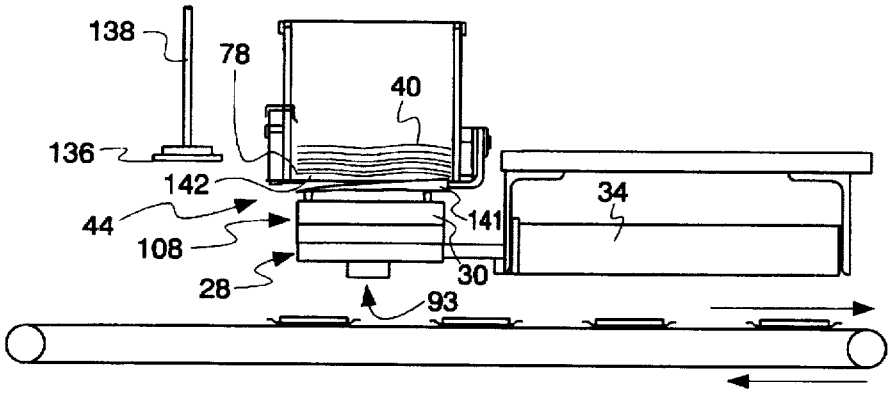
Figure 1D:
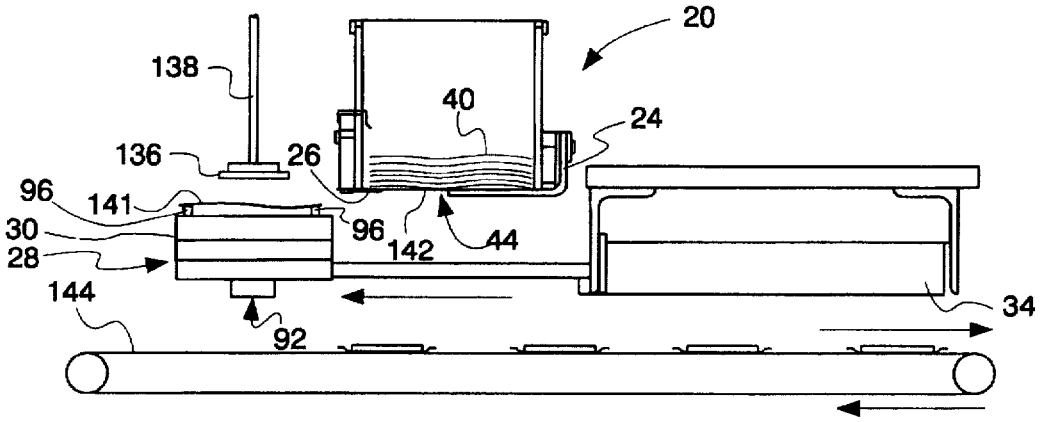
Figure 1E:
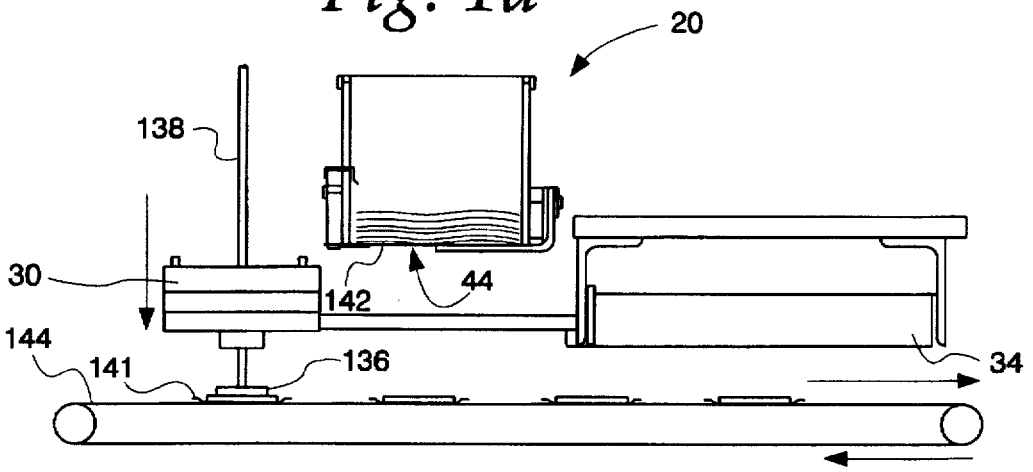
Figure 1F:
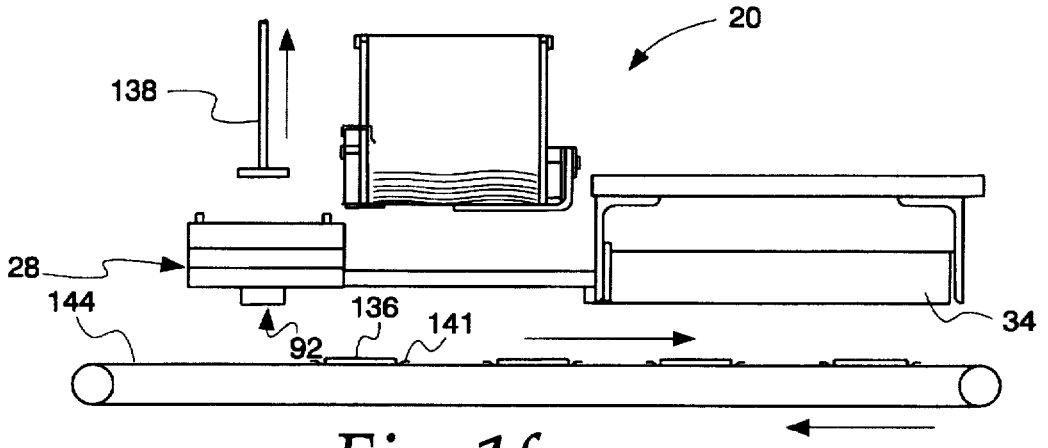

The second actuator 34 is a pneumatic cylinder which is adapted to move the carriage 28 between the paper loading position 93 beneath the hoppers, as best seen in FIGS. 1*a*, 1*b*, and 1*c*, and the laterally spaced paper dispensing position 92, as best seen in FIGS. 1*d*, 1*c*, and 1*f*. As best seen in FIG. 7, the second actuator 34 is mounted to the frame 36 by suitable fasteners 110 and to the carriage frame bar 82 by fastener 112.

It will be appreciated that while in the illustrated embodiment the first actuator 32 and the second actuator 34 are pneumatic cylinders, the invention contemplates that the first actuators 32 and the second actuator 34 may be in the form of any suitable actuator capable of generating the required motions.

Figure 2A:
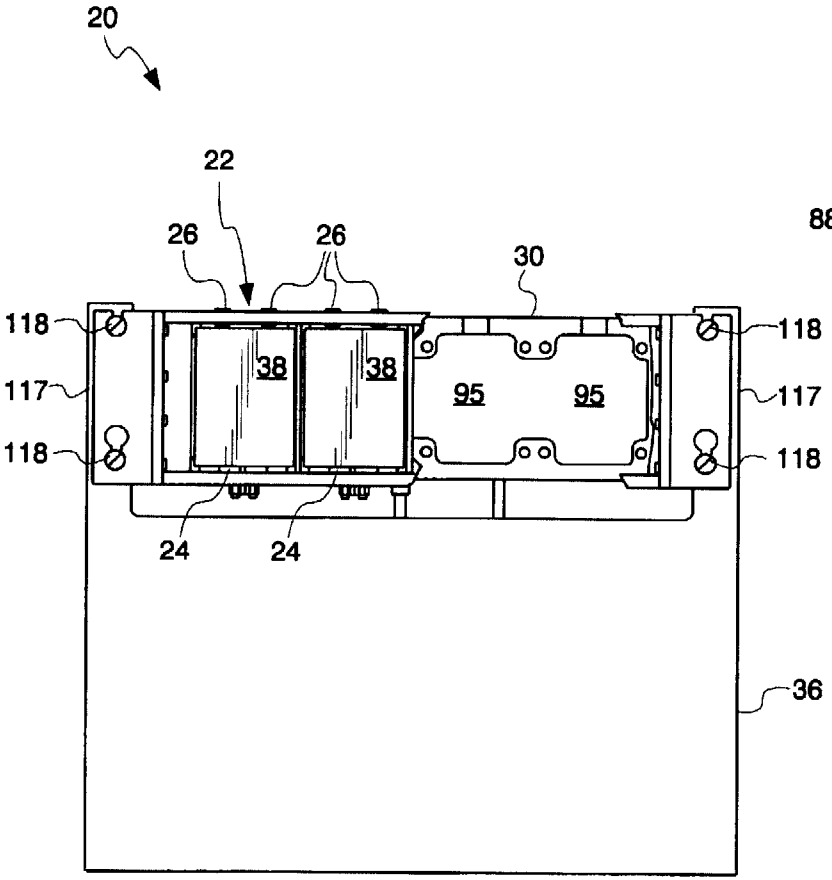
FIG. 2*a* is a top elevational view of a paper feed system shown in FIG. 1*a*, with a portion of the paper feed system broken away to reveal underlying details.

As best seen in FIGS. 6 and 7, the frame 36 includes a platen 114 and angle bars 115 which are joined to the platen 114 by suitable fasteners 116. The platen 114 includes two extensions 117 which serve as mount locations for the paper hopper 22, which is attached to the extensions 117 by suitable fasteners 118, as best seen FIG. 2*a*.

The paper feed system 20 further preferably includes a suitable position sensor 122 (see FIG. 7) mounted between the carriage 28 and the frame 36. The sensor 122 is capable of sensing the position of the carriage 28. The position sensor 122 includes a trip rod 124 fastened to the carriage 28 and guided for sliding linear motion by a bushing 126 in the angle bar 115 of the frame 36. The position sensor 122 further includes a proximity switch 128 which senses the position of the trip rod 124 and which sends position dependent electronic signals to the programmable controller (not shown) associated with a portion control machine 21. The proximity switch 128 is mounted to the frame 36 by a bracket 130 which is attached to the platen 114 by suitable fasteners 132.

The paper feed system 20 further include a paper support clip 134, as best seen in FIGS. 1*a* and 5. The support clip 134 is mounted to the paper hopper 22 at a selected distance from the open end 42 along the height of the paper hopper 22. The support clip 134 extends into the paper hopper 22 and contacts and supports the leading edges 78 of the paper sheets 40 in the stack 38, thereby limiting the free passage of the paper sheets 40 along the height of the paper hopper 22 and the weight of the stack 38 supported by the paper support tabs 26. The support clip 134 is self-attached to the hopper support frame 52.

The operation of the paper feed system 20 can best be understood with reference to FIGS. 1*a*, 1*b*, 1*c*, 1*d*, 1*e*, and 1*f*, which illustrate the sequence of operation for the paper feed system 20. In FIG. 1*a*, a portion 136 is positioned beneath a ram 138 in the portion control machine 21. A first paper sheet 141 is in the ready position 44 and the carriage 28 is in the paper loading position 93 adjacent the ready position 44. At this point a suitable controller (not shown) activates the first actuator 32 to translate the paper securing bar 30 from the second position 108 to the first position 106, as shown in FIG. 1*b*. When the securing bar 30 is in the first position 106, the vacuum cups 96 contact and secure the four corners of the first paper sheet 141 using the negative pressure from a vacuum source (not shown) associated with the portion control machine 21. It should be noted that the controller can be of any suitable configuration including a mechanical linkage, or an electronic controller based on, for example, time delays.

The controller then activates the first actuator 32 to translate the paper securing bar 30 from the first position 106 to the second position 108, where the edges of the first sheet 141 have been pulled from the ready position 44 by the vacuum cups 96 and where the first sheet 141 has been bent about the paper support 24 and pulled from the paper support tabs 26, as best seen in FIG. 1*c*. A second paper sheet 142 of the stack 38, immediately above the first paper sheet 141 is retained in the ready position 44 by the support tabs 26 and the paper support 24. The controller then activates the second actuator 34 to translate the carriage 28 from the paper loading position 93 to the paper dispensing position 92 adjacent the food portion 136, as shown in FIG. 1*d*.

The translation of the carriage 28 from the paper loading position 93 to the paper dispensing position 92 causes the paper securing bar 30 to slide the first sheet 141 off of the paper support 24 and from the ready position 44. The controller then deactivates the vacuum source, thereby causing the first paper sheet 141 to be released from the vacuum cups 96. The ram 138 then translates the portion 136 downward into contact with the paper sheet 141 and pushes the portion 136 and the paper sheet 141 through the paper dispensing station 95 in the open box shaped frame 94 of the paper securing bar 30 and into contact with a conveyor 144, as shown in FIG. 1*e*. It should be noted, that the conveyor 144 can delay its motion so that multiple portions 136 can be stacked with paper sheets 40 interleaved therebetween. Thus, the ram 138 does not, in every mode, extend fully down to the conveyor 144 as shown in FIG. 1*d*.

The portion ram 138 then translates upwards through the paper dispensing station 95, as shown in FIG. 1*f*. The controller then activates the second actuator 34 to translate the carriage 28 from the paper dispensing position 92 to the paper loading position 93, as shown in FIG. 1*a*, and the sequence is then repeated.

One advantage of the paper feed system 20 is that the second paper sheet 142 is positively retained in the paper hopper 22 by the paper support tabs 26 when the first paper sheet 141 is pulled from the ready position 44 by the paper securing bar 30. This is possible due to two unique features of the paper feed system 20.

First, as best seen in FIG. 1*c*, the paper support tabs 26 hold the leading edge 78 of the second paper sheet 142 against the front edge 46 of the paper hopper 22. The abutment of the leading edge 78 of the second paper sheet 142 against the front edge 46 prevents the leading edge 78 of the second paper sheet 142 from sliding out of the paper hopper 22 in the forward direction when the first paper sheet 141 is removed. The leading edge 78 of the second paper sheet 142 is retained by the support tabs 26 when the first paper sheet 141 is pulled from the paper support tabs 26 because the majority of the weight of the stack 38 of paper sheets 40 is supported by the paper support 24, with a relatively minimal amount of weight supported by the paper support tabs 26. This reduces the frictional force between the leading edge 78 of the first paper sheet 141 and the leading edge 78 of the second paper sheet 142, thereby allowing the first sheet 141 to be pulled from the paper tabs 26 without pulling the leading edge 78 of the second paper sheet 142 from the paper support tabs 26, which then secure the leading edge 78 of the second paper sheet 142 in the ready position 44.

Second, when the sides of the first paper sheet 141 have been removed from the ready position 44 (with the sides of the second paper sheet 142 retained in the ready position 44) and the first paper sheet 141 has been deformed about the paper support 24, the area of contact between the first paper sheet 141 and the second paper sheet 142 has been minimized and essentially equals only the area of the upper surface 73 of the paper support 24. This reduces the amount of surface adherence between the first and second sheets 141 and 142 and the length of sliding contact in the forward direction between the first and second sheets 141 and 142 when the first sheet 141 is slid in the forward direction from the ready position 44, thereby reducing the force exerted by the first sheet 141 on the second sheet 142 when the first sheet 141 is slid from the paper support 24.

Thus, the force exerted by the first sheet 141 on the second sheet 142 is insufficient to pull the second sheet 142 along the bottom of the stack 38 against the retention force exerted on the second sheet 142 by the front edge 46, the paper support tabs 26, and the remainder of the stack 38.

Additionally, the paper support clip 134 supports the weight of the leading edges 78 of the paper sheets 40 in the stack 38 which are at a height greater than the location of the paper support clip 134. This helps to insure that a somewhat uniform weight is supported by the paper support tabs 26 even when the paper hopper 22 is filled or half filled with paper sheets 40, thereby helping to provide predictable friction between the bottom two sheet 141 and 142.

Accordingly, the second sheet 142 is maintained within the paper hopper 22 and the paper sheets 40 are reliably dispensed a single paper sheet 40 at a time.

Another advantage is that the paper feed system 20 can be operated using as few as two simple linear actuators. Thus a simple, relatively inexpensive mechanism is provided for dispensing paper sheets between food portions without the use of exposed rotating gears, sprockets, and chain drives and their associated safety and cleanliness concerns.

Yet another advantage is that the entire paper feed system 20 can be operated using pneumatics, which is highly desirable due to the sanitary environment associated with food processing.

A further advantage is that the paper feed system 20 is capable of fully supporting a paper sheet 40 throughout the dispensing process, thereby allowing for the use of a broad range of paper sheet types and qualities.

This invention has been described in terms of specific embodiments set forth in detail, but it should be understood that these are by way of illustration only and that the invention is not necessarily limited thereto. Modifications and variations will be apparent from this disclosure and may be resorted to without departing from the spirit of this invention, as those skilled in the art will readily understand. Accordingly, such variations and modifications of the disclosed products are considered to be within the purview and scope of this invention and the following claims.

I claim:

1. A paper feed system suitable for use with a portion control machine to provide paper sheets for separating portions, said paper feed system comprising:

a paper hopper mountable to a portion control machine and adapted to receive and temporarily retain a stack of paper sheets, said paper hopper having an open end defining a ready position where a paper sheet lies in a first plane to be dispensed, said open end having a front edge spaced opposite from a back edge; and a paper support having a length to width ratio of 10:1 or greater and mounted adjacent the open end blocking the free exit of paper sheets therefrom, said support extending from a central location on the back edge partially to a central location on the front edge, with an upper surface of the support being substantially parallel with the first plane and adjacent the first plane for retention of a paper sheet in the ready position.

2. The paper feed system of claim 1 further comprising a stack of paper sheets temporarily retained in the paper hopper, each paper sheet being deformable about the support when the periphery of the paper sheet is removed from the paper hopper.

3. The paper feed system of claim 1 wherein the upper surface of the support has a curved cross section.

4. The paper feed system of claim 1 wherein the support is a rod having a circular cross section.

5. The paper feed system of claim 1 wherein the support extends one third to two thirds of the way from the back edge to the front edge.

6. The paper feed system of claim 1 wherein the support extends halfway from the back edge to the front edge.

7. The paper feed system of claim 1 further comprising a pair of paper support tabs mounted adjacent the central location on the front edge but spaced laterally from the support, said support tabs extending partially into the open end blocking the free exit of paper sheets therefrom, said support tabs having an upper surface substantially parallel with the first plane and adjacent the first plane for retention of a central portion of a leading edge of a paper sheet in the ready position.

8. The paper feed system of claim 1 wherein the paper hopper has a height extending from the open end for retaining a stack of paper sheets temporarily retained therein, and further comprising a paper support clip secured a selected distance from the open end along the height of the paper hopper, said support clip extending into the paper hopper limiting the free passage of a stack of paper along the height of the paper hopper.

9. The paper feed system of claim 1 further comprising means for removing a paper sheet from the ready position by withdrawing the sides of the paper sheet from the paper hopper and then sliding the paper sheet along the length of the support.

10. A paper feed system suitable for use with a portion control machine to provide paper sheets for separating portions, said paper feed system comprising:

a paper hopper mountable to a portion control machine and being adapted to receive and temporarily retain a stack of paper sheets, said paper hopper having an open end defining a ready position where a paper sheet lies in a first plane to be dispensed, said open end having a front edge spaced opposite from a back edge; and an elongated paper support rod mounted adjacent the open end blocking the free exit of paper sheets therefrom, said support rod extending from a central location on the back edge ⅓ to ⅔ of the way to a central location on the front edge, with a curved upper surface of the support rod being substantially parallel with the first plane and adjacent the first plane for retention of a paper sheet in the ready position.

11. The paper feed system of claim 10 wherein the support rod has a circular cross section.

12. The paper feed system of claim 10 further comprising a pair of paper support tabs mounted on the front edge and spaced laterally from the central location, said support tabs extending partially into the open end blocking the free exit of paper sheets therefrom, said support tabs having an upper surface substantially parallel with the first plane and adjacent the first plane for retention of a central portion of a leading edge of a paper sheet in the ready position.

13. The paper feed system of claim 10 wherein the paper hopper has a height extending from the open end for retaining a stack of paper sheets temporarily retained therein, and further comprising a paper support clip secured a selected distance from the open end along the height of the paper hopper, said support clip extending into the paper hopper limiting the free passage of a stack of paper along the height of the paper hopper.

14. The paper feed system of claim 10 further comprising means for removing a paper sheet from the ready position by withdrawing the periphery of the paper sheet from the paper hopper and then sliding the paper sheet along the length of the rod.

15. A paper feed system suitable for use with a portion control machine to provide paper sheets for separating food portions, said paper feed system comprising:

a paper hopper mountable to a portion control machine and adapted to receive and temporarily retain a stack of paper sheets with a paper sheet of the stack retained in a ready position where a surface of the paper sheet faces outward from the paper hopper;

a carriage mountable to a portion control machine for movement relative to the paper hopper between a paper dispensing position adjacent a food portion and a paper loading position adjacent the ready position;

a paper securing bar adapted for selectively securing to a paper sheet, said paper securing bar being mounted on the carriage for translating movement relative to the carriage along an axis substantially perpendicular to a plane defined by a paper sheet in the ready position, said paper securing bar including at least four vacuum cups connectable to a vacuum source, the cups located on the paper securing bar for selectively attaching a perimeter of a paper sheet to the paper securing bar; and a first actuator mounted on the carriage for translating the paper securing bar along said axis when the carriage is in the paper loading position, said first actuator being adapted to translate the paper securing bar between a first position where the paper securing bar will contact and secure to a paper sheet retained in the ready position and a second position, spaced from the ready position, where the paper securing bar will at least partially remove a paper sheet from the ready position.

16. The paper feed system of claim 15 further comprising a second actuator mountable to a portion machine for moving the carriage between the paper loading position and the paper dispensing position.

17. The paper feed system of claim 16 wherein the second actuator is a cylinder.

18. The paper feed system of claim 15 wherein the first actuator is a cylinder.

19. A paper feed system suitable for use with a portion control machine to provide paper sheets for separating food portions, said paper feed system comprising:

a paper hopper mountable to a portion control machine and adapted to receive and temporarily retain a stack of paper sheets, said paper hopper having an open end defining a ready position where a paper sheet lies in a first plane to be dispensed, said open end having a front edge spaced opposite from a back edge;

a paper support having a length to width ratio of 10:1 or greater and mounted adjacent the open end blocking the free exit of paper sheets therefrom, said support extending from a central location on the back edge partially to a central location on the front edge, with an upper surface of the support being substantially parallel with the first plane and adjacent the first plane for retention of a paper sheet in the ready position;

a carriage mountable to a portion control machine for movement relative to the paper hopper between a paper dispensing position adjacent a portion and a paper loading position adjacent the first plane;

a paper securing bar adapted for selectively securing to a paper sheet, said paper securing bar being mounted on the carriage for translating movement relative to the carriage along an axis substantially perpendicular to a plane defined by a paper sheet in the ready position; and a first actuator mounted on the carriage for translating the paper securing bar along said axis when the carriage is in the paper loading position, said first actuator being adapted to translate the paper securing bar between a first position where the paper securing bar will contact and secure to a paper sheet retained in the ready position and a second position spaced from the ready position, where the paper securing bar will at least partially remove a paper sheet from the ready position.

20. The paper feed system of claim 19 further comprising a pair of paper support tabs mounted adjacent the central location on the front edge but spaced laterally from the support, said support tabs extending partially into the open end blocking the free exit of paper sheets therefrom, said support tabs having an upper surface substantially parallel with the first plane and adjacent the first plane for retention of a central portion of a leading edge of a paper sheet in the ready position.

21. The paper feed system of claim 20 wherein the securing bar includes a pair of vacuum orifices located on the securing bar to contact and secure a paper sheet retained in the ready position on opposite sides of the support when the securing bar is in the first position.

22. The paper feed system of claim 21 further comprising:

a stack of paper sheets temporarily retained in the paper hopper; and wherein when the securing bar is in the second position;

a first sheet of the stack is secured to the securing bar by the pair of vacuum orifices, bent about the support, and pulled from the support tabs; and a second sheet of the stack is retained in the ready position by the support tabs.

* * * * *